US005280261A

United States Patent [19]

Mollet

[11] Patent Number: 5,280,261

[45] Date of Patent: Jan. 18, 1994

[54] CURRENT LIMITING FUSE

[75] Inventor: Ronald E. Mollet, Ellisville, Mo.

[73] Assignee: Cooper Industries, Inc., Houston, Tex.

[21] Appl. No.: 25,005

[22] Filed: Mar. 3, 1993

[51] Int. Cl.[5] ..... H01H 85/04; H01H 85/44

[52] U.S. Cl. ..... 337/158; 337/279; 337/295

[58] Field of Search ..... 337/273, 276, 279, 281, 337/246, 295, 293, 252, 158, 159, 160, 161, 162

[56] References Cited

U.S. PATENT DOCUMENTS

| | | | |
|---|---|---|---|
| 3,374,328 | 3/1968 | Cameron | 337/293 |
| 4,166,267 | 8/1979 | Belcher et al. | 337/295 |
| 4,228,417 | 10/1980 | Belcher | 337/252 |

*Primary Examiner*—Harold Broome

*Attorney, Agent, or Firm*—William B. Patterson; Eddie E. Scott; Alan R. Thiele

[57] ABSTRACT

An arc quenching, current limiting fuse utilizing a fuse link having a plurally of bends which cause the fuse link to come in contact or come in close proximity to the inside wall of the fuse body. When a short circuit and electrical arc occurs, the fuse link material burns toward the fuse wall creating an interaction with the fuse wall and an increase in pressure which extinguishes the arc.

7 Claims, 1 Drawing Sheet

FIG. 1
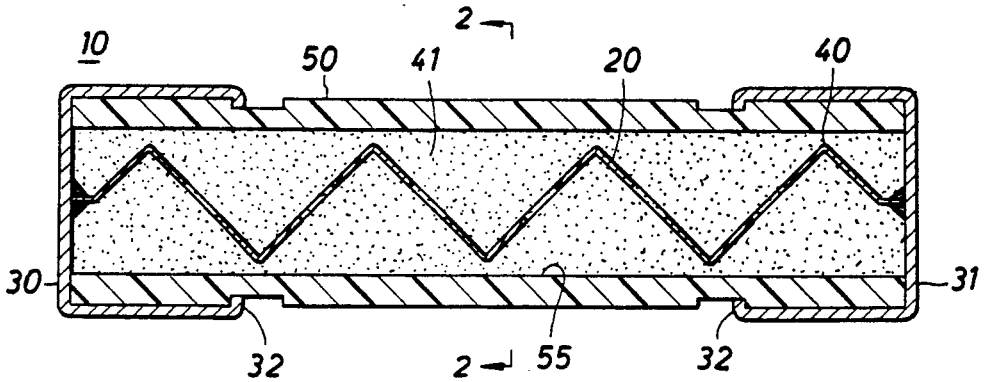
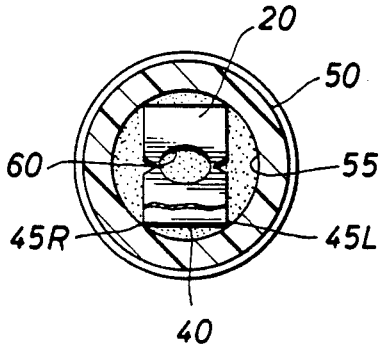
FIG. 2
FIG. 3
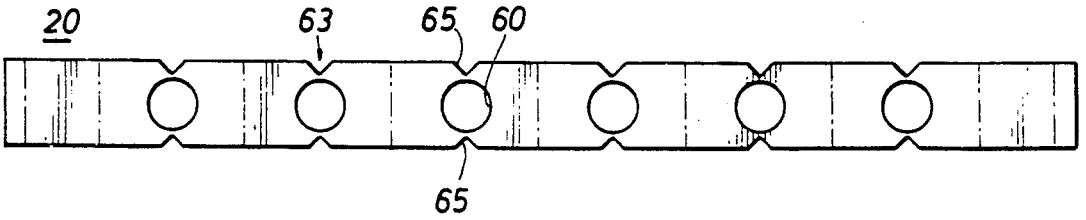

CURRENT LIMITING FUSE

The present invention relates to current limiting fuses; more particularly, the present invention relates to short, arc quenching fuses.

Current limiting fuses typically include a fuse link or short circuit strip which is electrically connected to the two metallic end caps located on either end of the fuse. The fuse link or short circuit strip is characterized by restricted segments or "weak spots". In the event of a short circuit current, the temperature of the fuse link increases until one or more weak spots melt. This break in the fuse link causes an electric arc to be established. As the fuse link material burns back away from the weak spot, the electric arc cannot be sustained and is extinguished. The voltage rating of a single link fuse is determined in part by the number of weak spots placed in series in the fuse link. Therefore, as the voltage rating of a current limiting fuse increases a longer fuse link and consequently, a longer fuse is required to allow for the additional weak spots placed in series in the fuse link.

Because of the continuing miniaturization of electrical equipment, there is a greater demand for smaller and smaller fuses to operate at current and voltage levels previously handled by larger fuses. For example, hand-held multi meters are now available to measure voltages of up to 1000 VAC and VDC. However, some of these hand-held devices can only accept fuses equal to or shorter than 1½" in length. Currently available 1½" long fuses capable of carrying current in excess of 10 amps will only operate satisfactorily at voltages of up to 600 volts.

There is a need therefore, for a current limiting fuse which is short enough in length to be used in miniaturized equipment but is also capable of carrying higher currents and interrupting short circuit current at higher voltages than currently possible with fuses of similar length.

There is a further need therefore, for a current limiting fuse which operates more effectively by interacting with the fuse body material to enhance the arc quenching characteristics of the fuse.

SUMMARY OF THE INVENTION

The arc quenching, current limiting fuse of the present invention is capable of handling voltages previously requiring fuses of a longer length. By utilizing a fuse link or short circuit strip which has a plurality of bends, a longer strip can be used in a shorter fuse body. Additionally, the multiple bends in the fuse strip cause the strip to contact or come in close proximity to the inside wall of the fuse body. When a short circuit and electrical arc occurs, the fuse link or short circuit strip material burns towards the fuse wall. This creates an interaction with the fuse wall and an increase in pressure which extinguishes the arc.

BRIEF DESCRIPTION OF FIGURES

FIG. 1 is a side view in section showing the fuse that is the subject of the present invention;

FIG. 2 is an end view of the fuse taken along a line 2—2; and

FIG. 3 is a view of the short circuit strip housed within the fuse body.

DESCRIPTION OF A PREFERRED EMBODIMENT

The invention can be best understood by reference to the figures. FIG. 1 depicts a cross-section of a current limiting arc quenching fuse 10. Fuse 10 includes fuse body 50 which is tubular in shape and is typically made of an insulating material impregnated with a melamine compound. While the fuse body material is a melamine compound in the embodiment described, it will be understood that the compound could include silicon or most any formable, non-conductive, organic material and still be within the purview of the invention. At each end of the fuse body 50 are metallic end caps 30, 31 which fit in a telescopic manner over the ends of fuse body 50. Caps 30 and 31 are mechanically connected to the body 50 by crimps 32. Silica sand 41 is dispersed in the tubular body 50 around the fuse link or short circuit strip 20. The purpose of the silica sand 40 is to absorb heat and assist in quenching an arc in the event of a short circuit.

Extending the length of the fuse body 50 and electrically connected to end caps 30, 31 is fuse link or short circuit strip 20. As depicted in FIG. 3, short circuit strip 20 is composed of a plurality of constricted areas or weak spots 63. In the preferred embodiment, each weak spot 63 includes an aperture 60 and two notches 65. The weak spots 63 could be formed in any number of ways so long as the cross sectional area of the strip 20 is reduced at the weak spot 60. For example, squares, triangles or oval shapes may be used in placed of circles 60 shown in the preferred embodiment. The weak spots 63 are designed to melt upon the occurrence of a short circuit, thus causing the circuit to open. Short circuit strip 20, in the preferred embodiment is made of silver but could be made of copper or any one of many conductive materials.

FIG. 1 depicts the novel arrangement of the short circuit strip 20 within fuse body 50. The strip 20 includes bends 40 at equally spaced intervals. While equally spaced intervals are shown in the preferred embodiment, it will be understood by those of ordinary skill in the art that unequally spaced intervals may be used without detracting from the invention. Bends 40 cause the short circuit strip 20 to travel from one side of fuse body 50 to the opposite side as it extends the length of the fuse body 50. At each bend 40, the short circuit strip 20 contacts the inside wall of the fuse body 50. FIG. 2 is an end view depicting the relationship of the short circuit strip 20 and the tubular body 50. As depicted, each bend 40 in short circuit strip 20 touches the inside wall 55 of fuse body 50 at two separate places 45L,R.

There are two purposes to the bends 40 in short circuit strip 20. The first purpose is to allow a longer strip to be used. Bending the strip 20 allows a longer strip to be used in fuse body 50 without increasing the overall length of the fuse body 50 and thus the overall length of fuse 10. Longer short circuit strip 20 allows for the location of more weak spots 63 in series on short circuit strip 20. Consequently, the fuse 10 can interrupt higher voltages than heretofore possible with straight-through short circuit strips having a low number of weak spots in series. Since the overall length of the fuse 10 can now be shorter, a fuse having a higher voltage rating can be used in a smaller fuse body 50 and thereby can be used in equipment where fuse space is limited. For example, by using the bent short circuit strip 20 of the invention, a 2" long strip can be used in a 1½" long fuse body 50.

In addition to space savings, the unique shape of the bent short circuit strip 20 causes the fuse 10 to interrupt current more effectively in the event of a short circuit condition. As the fuse 10 operates, one or more of the weak spots 63 will melt thus creating an arc which burns along the bent short circuit strip 20 away from the weak spot 63 and towards the inside fuse wall 55. As the arc consumes a portion of the short circuit strip 20 and approaches the tube wall 55, the heat of the arc interacts with the tube material to enhance the arc quenching characteristics of the fuse 10.

In the fuse 10 of the present invention, arc quenching is enhanced in two ways: First, as the arc approaches the tube wall 55, a greater amount of pressure is generated than would be present in a fuse not having the unique bent strip 20. Pressure, as is known by those skilled in the art, assists in arc quenching. Secondly, the organic material of the fuse body 50, as it is subjected to the heat of the arc, acts to reduce ionization within the arc, thereby causing the arc to be extinguished quicker than in prior art fuses.

Testing has demonstrated the effectiveness of the fuse 10 of the present invention with its bent short circuit strip 20 and melamine tube 50. For example, a fuse 10 according to the present invention with an overall length of 1½" successfully interrupted a current of 10,000 amps at 1000Vdc and a time constant (L/R) of 1.5 ms. By comparison, a 1½" fuse having a straight strip with out the bends of the new fuse failed. Additionally, a 2" fuse with a 2" straight strip failed as did a fuse with a bent strip in a 2½" non-organic, ceramic tube. The testing confirmed the value of the bent short circuit strip 20 when used with a tube of organic material.

The fuse of the present invention has bee described in its preferred embodiment. Those skilled in the art will appreciate that the structure of the fuse 10 could depart somewhat from that described herein and still be within the purview of the invention. For example, while the bent short circuit strip 20 touches the inside of the fuse wall 55 in the preferred embodiment, the fuse 10 of the present invention can operate effectively so long as the bends in the strip come close enough to the tube wall to cause the interaction between the short circuit strip 20 and tube material described herein. Additionally, in the preferred embodiment, the bends 40 in short circuit strip 20 are formed at an angle of approximately 90 degrees. However, the bends could form a larger angle resulting in fewer bends along the length of the strip 20 or smaller angles thereby increasing the number of spaced bends 40 along the strip. Also, the bends 40 could be more gradual, appearing as curves and providing a greater surface to interact with the tube wall 55. Finally, the short circuit strip of the present invention could be used in a dual element fuse providing overload protection in addition to short circuit protection. Such variations shall fall within the scope of the appended claims.

I claim:

1. A current limiting fuse, said current limiting fuse comprising:

a cylindrical, tubular body;

a first end cap in telescopic relation to a first end of said tubular body;

a second end cap in telescopic relation to a second end of said tubular body;

a short circuit strip having:

a first end and a second end, said first end of said short circuit strip electrically and mechanically connected to said first end cap and said second end of said short circuit strip electrically and mechanically connected to said second end cap; and a plurality of bends along said strip, said bends dividing said strip into a plurality of generally straight segments, each of said segments extending from one side of said body to an opposite side of said body;

a plurality of weak spots extending the length of said strip, said weak spots located along said generally straight segments;

arc quenching means between said short circuit strip and an inside wall of said tubular body, said arc quenching means including:

a plurality of contact locations between said strip and said inside wall of said body whereby; upon occurrence of an electrical arc said strip interacts with said inside wall of said body, thereby extinguishing said arc.

2. The current limiting fuse as defined in claim 1, wherein each of said bends form an angle in said strip of substantially 90 degrees.

3. The current limiting fuse as defined in claim 2, whereby said tubular body is made of an organic material.

4. The current limiting fuse as defined in claim 3, whereby said organic material is a melamine resin.

5. The current limiting fuse as defined in claim 4, wherein said strip is composed of silver.

6. The current limiting fuse as defined in claim 1, hereby said fuse is a dual element fuse and includes means for limiting over currents.

7. An electronic, hand-held multi meter for measuring voltages in electrical equipment, said multi meter comprising:

a housing;

electronic circuitry; and a current limiting fuse, said current limiting fuse comprising:

a cylindrical, tubular body;

a first end cap in telescopic relation to a first end of said tubular body;

a second end cap in telescopic relation to a second end of said tubular body;

a short circuit strip, said strip having:

a first end and a second end, said first end of said short circuit strip electrically and mechanically connected to said first end cap and said second end of said short circuit strip electrically and mechanically connected to said second end cap;

a plurality of bends along said strip, said bends dividing said strip into a plurality of generally straight segments, each of said segments extending from one side of said body to an opposite side of said body;

a plurality of weak spots extending the length of said strip said weak spots located along said generally straight segments and;

arc quenching means between said short circuit strip and an inside wall of said tubular body, said arc quenching means including:

a plurality of contact locations between said strip and said inside wall of said body; whereby upon occurrence of an electrical arc said strip interacts with said inside wall of said body, thereby extinguishing said arc.

* * * * *